US010087929B2

(12) United States Patent
Welte

(10) Patent No.: US 10,087,929 B2
(45) Date of Patent: Oct. 2, 2018

(54) PUMP INCLUDING A SPRING FASTENED TO POSITIONING ELEMENTS

(71) Applicant: SCHWÄBISCHE HÜTTENWERKE AUTOMOTIVE GMBH, Aalen-Wasseralfingen (DE)

(72) Inventor: Claus Welte, Aulendorf (DE)

(73) Assignee: SCHWABISCHE HUTTENWERKE AUTOMOTIVE GMBH, Aalen-Wasseralfingen (DE)

( * ) Notice: Subject to any disclaimer, the term of this patent is extended or adjusted under 35 U.S.C. 154(b) by 0 days.

(21) Appl. No.: 15/130,105

(22) Filed: Apr. 15, 2016

(65) Prior Publication Data

US 2016/0305427 A1 Oct. 20, 2016

(30) Foreign Application Priority Data

Apr. 17, 2015 (DE) ..... 10 2015 105 928

(51) Int. Cl.
*F03C 2/00* (2006.01)
*F03C 4/00* (2006.01)
(Continued)

(52) U.S. Cl.
CPC ..... *F04C 2/3448* (2013.01); *F01C 21/108* (2013.01); *F04C 2/3446* (2013.01); *F04C 15/00* (2013.01); *F01C 19/005* (2013.01); *F04C 2210/206* (2013.01); *F04C 2230/603* (2013.01); *F04C 2240/20* (2013.01); *F04C 2240/30* (2013.01)

(58) Field of Classification Search
CPC ..... F04C 2/3446; F04C 2/3448; F04C 15/00; F04C 2210/206; F04C 2230/60; F04C 2230/603; F04C 2240/20; F04C 2240/30; F01C 21/0863; F01C 21/0809; F01C 21/08; F01C 19/005
USPC ... 418/133–13, 140, 259, 266–268, 133–135
See application file for complete search history.

(56) References Cited

U.S. PATENT DOCUMENTS 3,207,077 A 9/1965 Zeigler et al.
4,505,655 A 3/1985 Honaga et al.
(Continued)

FOREIGN PATENT DOCUMENTS

CN 2012026640 Y 3/2009
DE 2423773 11/1975
(Continued)

OTHER PUBLICATIONS

The European Search Report dated Aug. 18, 2016, by the European Patent Office in corresponding European Application No. 16164901.7. (9 pages).

(Continued)

*Primary Examiner* — Theresa Trieu
(74) *Attorney, Agent, or Firm* — Buchanan Ingersoll & Rooney PC

(57) ABSTRACT

A pump including a rotor; a first housing part and a second housing part, between which the rotor is arranged such that it can be rotated about a rotational axis relative to the first and second housing part; at least one positioning element which positions the second housing part with respect to its angular position about the rotational axis relative to the first housing part; and a spring, wherein the second housing part is arranged between the spring and the rotor, wherein the spring is fastened to the at least one positioning element or the second housing part.

17 Claims, 7 Drawing Sheets

(51) Int. Cl.

| | |
|---|---|
| ***F04C 2/00*** | (2006.01) |
| ***F04C 2/344*** | (2006.01) |
| ***F01C 21/10*** | (2006.01) |
| ***F04C 15/00*** | (2006.01) |
| *F01C 19/00* | (2006.01) |

(56) References Cited

U.S. PATENT DOCUMENTS

| | | | |
|---|---|---|---|
| 7,488,162 | B2 | 2/2009 | Jordan |
| 2006/0051230 | A1 | 3/2006 | Jordan |
| 2011/0211985 | A1 | 9/2011 | Dippel |
| 2014/0199199 | A1 | 7/2014 | Meinig |
| 2015/0125332 | A1 | 5/2015 | Rosenkranz et al. |

FOREIGN PATENT DOCUMENTS

| | | | |
|---|---|---|---|
| DE | 203 02 535 | U1 | 6/2009 |
| DE | 10 2013 209 877 | A1 | 12/2014 |
| EP | 2754896 | A1 | 7/2014 |
| WO | WO 2013/185751 | A1 | 12/2013 |

OTHER PUBLICATIONS

German Office Action dated Oct. 29, 2015 for Application No. 10 2015 105 928.2, with English language translation, 6 pages.

Office Action dated Sep. 29, 2017, by the Chinese Patent Office in corresponding Chinese Patent Application No. 201610232347.8 (10 pages).

PUMP INCLUDING A SPRING FASTENED TO POSITIONING ELEMENTS

BACKGROUND OF THE INVENTION

The invention relates to a pump, in particular a displacement pump, for a liquid such as for example oil. The pump can for example be embodied as a vane cell pump or a rotary vane pump. The pump is in particular suitable for being installed in a vehicle, such as for example a motor vehicle, and/or for supplying a consumer in a motor vehicle. The consumer can for example be an internal combustion engine or a transmission, such as for example a steering gear or automatic transmission. A first aspect relates to configuring or fastening a spring of the pump. A second aspect relates to configuring a shaft-hub connection of the pump.

WO 2013/185751 A1 discloses a so-called cartridge pump which comprises a pump assembly which consists substantially of a rotor, a stroke ring, a side plate, a pressure plate, pressing pins and a spring element. The rotor is accommodated, such that it can be rotated, between the pressure plate and the side plate and is surrounded by the stroke ring, which is likewise arranged between the pressure plate and the side plate. The pressure plate, the side plate and the stroke ring are secured, rotationally and axially fixed with respect to each other, by a number of pressing pins which are pressed, axially fixed, into the pressure plate and penetrate through the side plate and the stroke ring. The spring element is fastened to the pressure plate on the end-facing side of the pressure plate which points away from the rotor. The pump assembly can be inserted into a cup-shaped housing, wherein the spring element is supported on the base of the cup-shaped housing. The housing is sealed by a housing cover which holds the pump unit in its installed position. The rotor comprises an inner structure for a shaft-hub connection to a pump shaft.

SUMMARY OF THE INVENTION

The first aspect is based on the object of specifying a space-saving pump which is cost-effective to manufacture. The second aspect is based on the object of reducing wear in the pump.

The invention proceeds from a pump, in particular a displacement pump, such as for example a vane cell pump or rotary vane pump. The pump comprises a housing which encloses a pump space. A rotor can be arranged in the pump space, such that it can be rotated about a rotational axis relative to the housing. The pump can comprise the rotor and at least a first housing part, in particular a first housing cover, and a second housing part, in particular a second housing cover, between which the rotor is arranged such that it can be rotated about a rotational axis relative to the first and second housing part. The rotor can be connected or able to be connected directly or indirectly to a pump shaft, in a way which transmits torque, such as for example via a shaft-hub connection, in particular in accordance with the second aspect. When the pump shaft is rotated relative to the first and second housing part, the rotor is rotated along with it. The rotor comprises cavities, in particular guides, in which delivery elements such as for example vanes, sliders or rollers are accommodated such that they can be moved, in particular shifted, radially with respect to the rotational axis. The delivery elements are accommodated or mounted by the rotor such that they are rotated along with the rotor about its rotational axis.

The pump shaft can extend through the housing and can be mounted on the housing such that it can be rotated about the rotational axis, such as for example with a first portion mounted on the first housing part and a second portion mounted on the second housing part. An outer structure for the shaft-hub connection can be formed between the first portion and the second portion of the pump shaft. The rotor and the pump shaft can be non-rotationally connected by means of a straight-toothed shaft-hub connection. The shaft-hub connection comprises an inner toothed gearing featuring a number of teeth, and an outer toothed gearing which features a number of teeth and engages with the inner toothed gearing.

A third housing part, in particular a stroke ring, which surrounds the rotor over its circumference can be arranged between the first housing part and the second housing part. The annularly embodied third housing part can be a part which is separate from the first and second housing part. Alternatively, the third housing part can be a portion of the first housing part which is formed by the first housing part, or a portion of the second housing part which is formed by the second housing part. The first housing part or the second housing part or both can surround the rotor and in particular its delivery elements, such as for example annularly.

The first housing part, second housing part and third housing part enclose and delineate a pump chamber in which the rotor and the delivery elements are arranged. At least one delivery chamber is formed radially between the third housing part and the rotor which is trapped between the first and second housing part such that it can be rotated.

A delivery cell is respectively formed between adjacent delivery elements and is delineated circumferentially by an inner circumferential surface of the third housing part and along the rotational axis by the first housing part on one side and by the second housing part on the other side and changes its volume as a function of the rotational position of the rotor about its rotational axis. The pump comprises a multitude of delivery elements and therefore a multitude, in particular an identical multitude, of delivery cells which are formed between the delivery elements.

The inner circumference of the third housing part exhibits a contour along which the delivery elements slide when the rotor rotates. The contour is in particular embodied such that the delivery cells moving through the delivery chamber due to the rotation of the rotor initially increase in volume and then decrease in volume. In one complete revolution of the rotor, the delivery elements are moved away from the rotational axis and towards the rotational axis at least once. The pump can for example be embodied as a twin-stroke pump, i.e. can be embodied with a first delivery chamber and a second delivery chamber, through each of which the delivery elements and/or delivery cells pass once during one complete revolution. This means that in one complete revolution, the delivery elements are alternately moved away from the rotational axis twice and towards the rotational axis twice. During a rotation of the rotor, a delivery cell initially increases in volume and then decreases in volume.

The pump can comprise a first channel, which ports into the region of the delivery chamber in which a delivery cell increases in volume, and a second channel which ports into the region of the delivery chamber in which said delivery cell decreases in volume. Due to the increase in the volume of the delivery cell, the first channel acts as a suction channel. Due to the decrease in volume, the second channel acts as a pressure channel. A multi-stroke pump can comprise a number of suction channels and a number of pressure channels. In a twin-stroke pump, two pressure channels and two suction channels can be provided. A first suction channel can port into the first delivery chamber, and a second suction channel can port into the second delivery chamber. A first pressure channel can port into the first delivery chamber, and a second pressure channel can port into the second delivery chamber. The fluid delivered via the first delivery chamber can for example be supplied to other consumers or the same consumers as the fluid delivered via the second delivery chamber. If different consumers are supplied, different pressure levels between the first pressure channel and the second pressure channel can be created. The delivery elements and/or the rotor respectively form a sealing gap with the first housing part and the second housing part. The at least one suction channel can be connected to and in particular in fluid communication with a fluid storage container, such as for example an oil container. The at least one pressure channel can be connected to at least one fluid consumer and for example be in fluid communication with a transmission.

The pump can comprise at least one positioning element which positions the second housing part with respect to its angular position about the rotational axis relative to the first housing part. The at least one positioning element can be formed by the first housing part, in particular integrally or monolithically. Alternatively, the at least one positioning element can be formed as a part which is separate from and anchored in the first housing part. The positioning element can for example be screwed or pressed into the first housing part, i.e. anchored in a positive fit and/or force fit. Alternatively or additionally, the at least one positioning element can be anchored in a material fit, such as for example glued, soldered or welded, in the first housing part. The first housing part can comprise one bore for each positioning element, wherein one end of the positioning element is inserted into the bore and thus anchored in the first housing part.

The at least one positioning element can in particular be pin-shaped or cylindrical. The end of the positioning element which lies opposite the anchored end can for example exhibit the same outer diameter as the anchored end.

The second housing part and in particular also the third housing part can be mounted on the at least one positioning element, secured against rotating about the rotational axis. The at least one positioning element can extend through a cavity in the second housing part, such as for example a bore or transit bore, one of which is provided for each positioning element. The at least one positioning element can for example extend through a cavity in the third housing part which can for example be embodied as a bore, an elongated hole or the like.

The end of the at least one positioning element which lies opposite the end anchored in the first housing part can in particular protrude out of the second housing part and in particular from the end-facing side of the second housing part which lies opposite the end-facing side pointing towards the rotor, or which points towards an end-facing wall of an accommodating housing.

The pump can comprise a spring, such as for example a disc spring in accordance with the first aspect, the second housing part can be arranged between the spring and the rotor. The spring can for example be supported on the second housing part and on an accommodating housing, in particular an end-facing wall of the accommodating housing. The accommodating housing can for example be cup-shaped. The accommodating housing can comprise a circumferential wall which extends around the rotational axis of the rotor, and an end-facing wall which is arranged on the end-facing side of the circumferential wall, wherein the second housing part is surrounded over its circumference by the circumferential wall, and the spring—such as for example a main portion of the spring—is supported on the end-facing wall. The spring seeks to press the second housing part away from the end-facing wall of the accommodating housing.

The spring can in particular be fastened to the at least one positioning element. The spring can for example be connected to the positioning element in a positive fit, in particular snapped onto it, or in a force fit, such that the spring is held on the at least one positioning element and preferably is or can be supported on the second housing part. Preferably, the spring is fastened to the at least one positioning element, secured against rotating about the rotational axis, in particular in a positive fit and/or force fit. Alternatively, the spring can be fastened to the second housing part, such as for example in a positive fit.

The spring can for example comprise a main portion which can flex towards and away from the first housing part along the rotational axis. In particular, a spring gap can exist between the second housing part and the main portion of the spring when the spring is relaxed, such that the main portion of the spring can be moved towards the second housing part, simultaneously tensing the spring. The spring can comprise a supporting portion which is connected to the main portion, wherein the spring gap exists between the second housing part and the main portion. The at least one supporting portion can for example be supported, in particular over an area, on the second housing part. The main portion is in particular provided so as to be supported, for example over an area, on the end-facing wall of the accommodating housing, in particular on a protrusion of the end-facing wall which is for example annular.

At least some of the main portion can be arranged between the rotational axis and the at least one supporting portion. This means that the main portion is offset more closely towards the rotational axis than the at least one supporting portion. The main portion can for example be annular, wherein a number of supporting portions in particular one for each positioning element—project from the main portion. The main portion can in particular be arranged such that it is offset in relation to the at least one supporting portion along the rotational axis. The spring can thus on the one hand be supported on the second housing part and on the other hand can flex towards the second housing part.

The main portion of the spring can comprise a cavity, in particular an aperture which is for example circular and through which the pump shaft—and/or a structure of the second housing part which forms the pump shaft mounting—extends. The structure which forms the pump shaft mounting can be an annular structure which is integrally formed on the second housing part and projects from the second housing part towards the end-facing wall of the accommodating housing. It is thus possible to form a large bearing surface for the pump shaft, and the thickness of the second housing part can also be kept low.

The spring can comprise or form at least one fastening element, in particular on or in the region of the supporting portion. The at least one fastening element can for example serve as the supporting portion, or one fastening element can be provided for each supporting portion. By means of the fastening element, the spring can be fastened or able to be fastened to the at least one positioning element or the second housing part. The fastening element, which is for example embodied for a positive-fit connection to the positioning element, can be snapped onto the at least one positioning element.

The at least one positioning element can comprise a cavity, such as for example an annular groove over its circumference, with which the at least one fastening element of the spring engages. Such an annular groove can be embodied as a clearance groove. The at least one fastening element can for example be embodied in the shape of a securing disc or retaining ring, similar to securing discs for shafts in accordance with DIN 6799 or securing rings for shafts in accordance with DIN 471, in particular with the difference that they can be formed by the spring, i.e. integrally formed on the supporting portion.

In alternative embodiments, the securing element—in particular, the securing disc embodied for example in accordance with DIN 6799 or the retaining ring embodied in accordance with DIN 471—can be an actual disc or ring, i.e. not integrally formed on the spring, and can for example merely serve to ensure that the second housing part cannot be axially removed from the positioning element. In this embodiment, the spring can be fastened to the second housing part or to the securing element or trapped between the securing element and the second housing part, wherein the fastening element of the spring can be fitted onto the positioning element. In alternative embodiments, the positioning element can for example be embodied with a tip, wherein the second housing part is trapped between the first housing part and the tip, such that the second housing part is prevented from being removable from the first housing part and/or the positioning element. In these embodiments, the spring can be fastened to the second housing part or to the tip or trapped between the tip and the second housing part, wherein the fastening element of the spring can be fitted onto the positioning element.

In other embodiments, the cavity can be an annular groove which extends over the circumference of the cylindrical or pin-shaped positioning element and exhibits a width, extending along the longitudinal axis of the positioning element, which is dimensioned such that the fastening element of the spring is accommodated in the annular groove with a clearance along the longitudinal axis. It is thus possible to ensure that the supporting portion or the fastening element of the spring is supported on the second housing part and not on a groove flank of the annular groove.

The pump can comprise a pump shaft which is non-rotationally connected to the rotor and can be rotated about the rotational axis. The pump shaft can be mounted such that it can be rotated in at least the first housing part. The pump shaft can additionally be mounted such that it can be rotated in the second housing part, in particular in a blind cavity or a continuous cavity, in particular a bore, through the second housing part. The blind cavity has the advantage that the pump chamber is sealed off with respect to the end-facing side of the second housing part which points away from the pump chamber. The continuous cavity has the advantage that it is easier to produce and ensures a greater level of stability. The bearing(s) can be slide bearings or roll bearings.

The pump shaft comprises a structure, in particular an outer toothed gearing, for a shaft-hub connection to the rotor. The diameter of the structure can be larger than the inner diameter of the first housing part and/or the second housing part or the bearings. The structure is therefore trapped between the first housing part and the second housing part along the rotational axis. This means that the shaft cannot be drawn out of the completely assembled pump assembly.

In accordance with the second aspect, the shaft-hub connection can be embodied such that the rotational axis of the pump shaft can be tilted, in particular pivoted, in relation to the rotational axis of the rotor by a small angular distance, i.e. by a few angular degrees at most. Ideally, the rotational axis of the rotor and the rotational axis of the pump shaft are congruent. In embodiments comprising a first and second housing part, the second housing part can be positioned relative to the first housing part, wherein minimal errors can occur which cause the rotational axis of the pump shaft to be slightly oblique in relation to the rotational axis of the rotor. In a conventional shaft-hub connection, there is a danger of the rotor being pressed against its lateral enclosure at locations if the rotational axes are oblique with respect to each other in this way, such that a high degree of friction is created at this/these location(s), therefore increasing wear. Due to the high degree of friction, the effectiveness of the pump also decreases. Since the rotational axis of the pump shaft can be tilted in relation to the rotational axis of the rotor, such as for example by 3° at most or in particular by 1° at most, such angular errors can be compensated for, without pressing the rotor firmly against the housing at locations. The effectiveness of the pump does not then decrease if the rotational axes are oblique, and wear does not increase.

The teeth or each tooth of the inner and/or outer toothed gearing can respectively be embodied to be elongated and its longitudinal direction can extend along and in particular parallel to the rotational axis. The teeth can be arranged in a distribution over the outer circumference of the shaft or inner circumference of the rotor, respectively.

The teeth or each tooth of the inner toothed gearing of the shaft-hub connection, which can for example be formed by the rotor or by an intermediate part which is connected, rotationally fixed, to the rotor, can respectively exhibit a tip surface which is curved convexly towards the rotational axis of the rotor over its length extending along the longitudinal axis of the rotor. The tip surface can be curved in one or two dimensions. The teeth or each tooth of the outer toothed gearing of the pump shaft can respectively exhibit a tip surface which is curved convexly away from the rotational axis of the pump shaft over its length extending along the longitudinal axis of the rotor. The tip surface is the surface which is formed between the flanks of a tooth and which forms the free end of the tooth.

The convexly curved tip surface can consist of a roundly curved surface or can be formed from a number of surface portions, such as for example level or planar surface portions, which abut each other and are angled with respect to each other such that they form a convexly curved tip surface.

The inner and/or outer toothed gearing or each tooth thereof can comprise a first end and a second end along the rotational axis of the rotor or pump shaft. One or each tooth can exhibit a tooth height which decreases from a region between the first end and the second end towards at least one of the first end and the second end. The tooth height can for example be at its greatest in the region of the middle between the first and second end of a tooth, wherein it decreases towards the first and/or second end. The first and second ends of the tooth can be provided with a facet, wherein the tip surface does not include the facet. A facet is generally applied at an angle of 30° or 45°, wherein the tangent onto the convexly curved tip surface or onto the plane, such as for example the first or second surface portion, of the convexly curved tip surface is inclined at an angle of for example 3° at most, in particular 1° at most, in relation to the rotational axis of the rotor or pump shaft.

The tooth height can decrease towards the first or second end progressively, i.e. at an increasing pitch, or linearly, i.e. at a constant pitch.

The respective tooth height can be formed between the root of a tooth and the tip surface of each tooth. The tip surface can be crowned between the first end and the second end.

The tip surface of the respective tooth can be planar, at least in portions, between the first end and the second end, wherein the planar surface portion is inclined or parallel in relation to the rotational axis. The planar surface portion arranged approximately in the middle between the first end and the second end can for example be parallel to the rotational axis. The tip surface can in particular comprise a first surface portion and a second surface portion, wherein the second surface portion is arranged between the first surface portion and the first end, wherein the tooth height is constant in the first surface portion and decreases towards the first end in the second surface portion. The tip surface can also comprise a third surface portion, wherein the third surface portion is arranged between the first surface portion and the second end, wherein the tooth height decreases towards the second end in the third surface portion.

As an alternative to or in addition to the teeth exhibiting a convexly curved tip surface, the teeth of the inner toothed gearing and/or the outer toothed gearing can respectively exhibit a convexly curved first tooth flank surface and/or a convexly curved second tooth flank surface over their length extending along the rotational axis. The curved tooth flank surface can consist of a roundly curved surface or can be formed from a number of surface portions, such as for example level or planar surface portions, which abut each other and are angled with respect to each other such that they form a convexly curved tooth flank surface.

The tooth or each tooth of the inner toothed gearing and/or the outer toothed gearing exhibits a tooth width between the first and second tooth flank surface. The tooth width decreases from a region between the first end and the second end towards at least one of the first end and the second end, preferably towards both ends. The tooth width can decrease towards the first or second end progressively, i.e. at an increasing pitch of the tangent onto the first or second tooth flank surface, or linearly. The first and/or second tooth flank can in particular be crowned.

The first tooth flank or the second tooth flank is planar, at least in portions, between the first end and the second end, wherein the planar surface portion is inclined or parallel in relation to the rotational axis. The first and/or second tooth flank surface can comprise a first surface portion and a second surface portion, wherein the second surface portion is arranged between the first surface portion and the first end, wherein the tooth width is constant in the first surface portion and decreases towards the first end in the second surface portion. The first and/or second tooth flank can respectively comprise a third surface portion, wherein the third surface portion is arranged between the first surface portion and the second end, wherein the tooth width decreases towards the second end in the third surface portion.

A pump assembly which can be handled as a unit is substantially formed in particular by the first housing part, the second housing part, the third housing part, the rotor, the delivery elements, the positioning elements, the spring and the pump shaft. Since the spring is fastened to the at least one positioning element, it is possible to prevent the assembly from falling apart. The fastening elements of the spring or the securing elements which are separate from the spring axially secure the shaft, such that the pump assembly does not fall apart.

Since the pump assembly is easy to handle, it can be accommodated and/or inserted into the accommodating housing—which can for example be formed by a transmission housing for a motor vehicle—for example via an opening in the accommodating housing which lies opposite the end-facing wall.

The pump and/or pump assembly is prevented from falling out of the accommodating housing by for example a cover or an axial securing element, wherein the spring which is tensed when the pump and/or pump assembly is inserted presses the pump assembly, in particular the first housing part, against the axial securing element, wherein the axial securing element prevents the spring from being relaxed. The axial securing element can for example be annular and inserted into an annular groove which is formed on the preferably cylindrical inner circumference of the accommodating housing. The axial securing element can be formed by a cover which at least partially or completely seals the opening.

In other embodiments, a seal which can be arranged between the second housing part and the accommodating housing, in particular the circumferential wall, seals off a first space, which is formed between the end-facing wall and the second housing part, in relation to a second space which is formed between the circumferential wall and the first and/or third housing part. The first space can for example be connected to the pump chamber, in which the rotor is arranged, by means of the first channel. The second space can for example be connected to the pump chamber by means of the second channel. In particular, the first space can be arranged on the suction side and the second space can be arranged on the pressure side, or the second space can be arranged on the suction side and the first space can be arranged on the pressure side. The pressure space can correspondingly be formed between the end-facing wall and the second housing part, wherein the suction space can be formed between the circumferential wall and the first and/or third housing part. The suction space can be connected to the at least one delivery chamber by the at least one suction channel. The pressure space can be connected to the at least one delivery chamber by the at least one pressure channel.

An additional seal can be arranged between the first housing part and the accommodating housing, in particular the circumferential wall, wherein the second space is arranged between the first and second seal. The second seal can seal off the second space with respect to the outside or with respect to the opening in the accommodating housing.

If the first space is arranged on the suction side of the pump chamber and the second space is arranged on the pressure side, the axial securing element is only exposed to a small axial force while the pump is in operation. The spring force should however then be selected to be at least significant enough that parts of the pump assembly are compressed along the rotational axis at least significantly enough that the pump space is sufficiently sealed off.

If the first space is arranged on the pressure side and the second space is arranged on the suction side, the second housing part acts like a piston which, when the pressure is increased, increases the force on the axial securing element along the rotational axis and therefore also presses the parts of the pump assembly against each other in a seal, namely with a force which increases as the delivery pressure increases.

The spring can be formed from metal, such as for example spring steel. Alternatively or additionally, the spring can comprise a plastic, such as for example an elastomer material or polymer material. The spring can for example be formed from an elastomer material or polymer material or from a metal spring which is partially or completely coated in the plastic, such as for example by injection-moulding the plastic around the metal spring. This has the advantage that the spring can also perform a twin function as a seal. The end-facing wall can for example comprise a projection or a seal seating on which the spring is supported in a seal, in particular via the surface of the spring which is formed from the plastic. The second housing part can comprise a seal seating on which the spring is supported in a seal, in particular via the surface which is formed from the plastic.

The spring which is embodied as a seal can for example seal off a first part of the pressure space, into which the first outlet channel ports, with respect to a second part of the pressure space into which the second outlet channel ports. It is then possible to provide a pump which exhibits two pressure levels.

The spring which is embodied as a seal can for example seal off the pressure space, into which the first and as applicable the second outlet channel port/ports, with respect to the suction space into which the first and as applicable the second inlet channel port/ports.

BRIEF DESCRIPTION OF THE DRAWINGS

The invention has been described on the basis of a number of examples and embodiments. Particularly preferred embodiments of the invention are described on the basis of figures. The features thus disclosed, individually and in any combination of features, advantageously develop the subject-matter of the invention. There is shown.

DETAILED DESCRIPTION OF THE INVENTION

Figure 1:
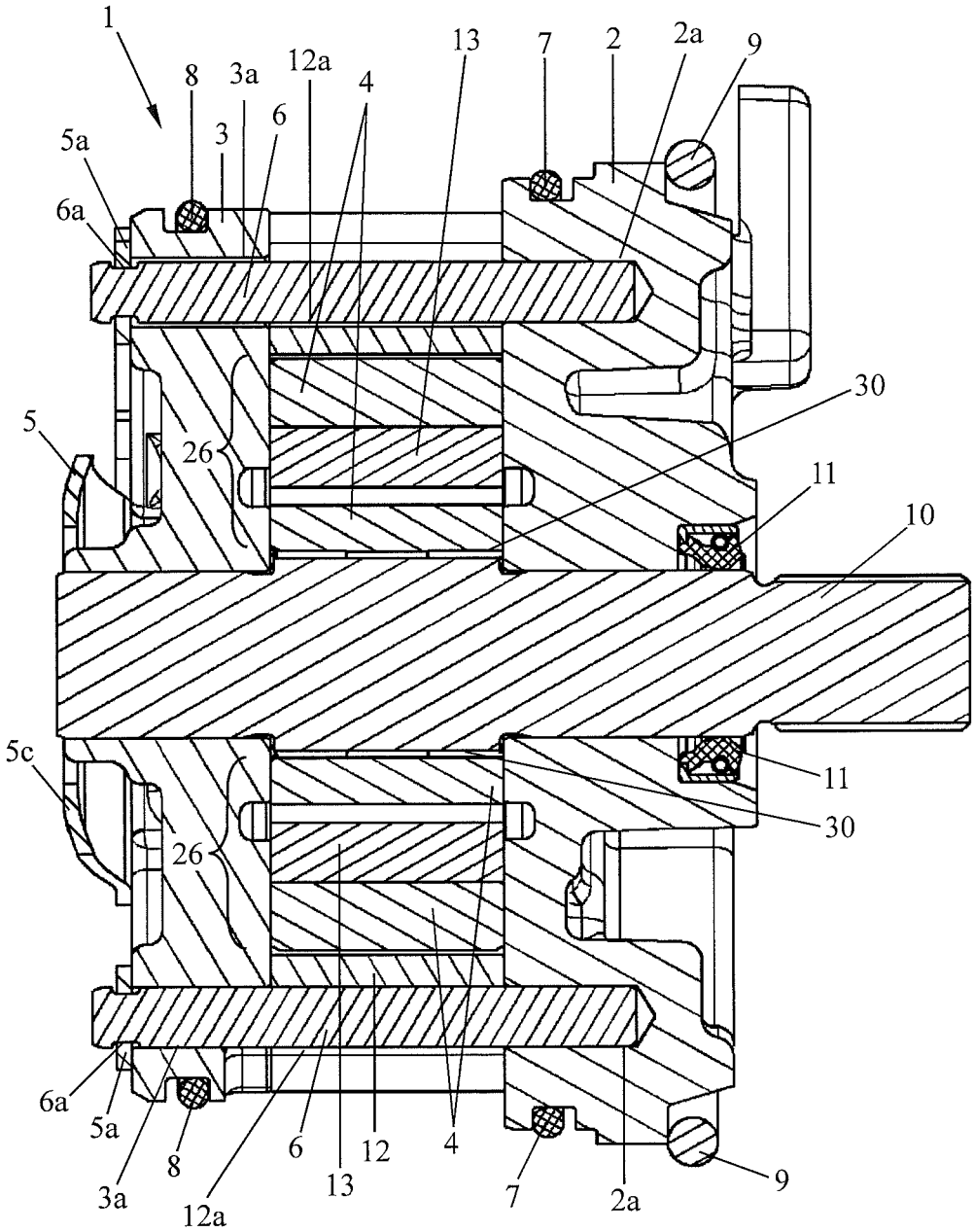
FIG. 1 a pump assembly.
Figure 2:
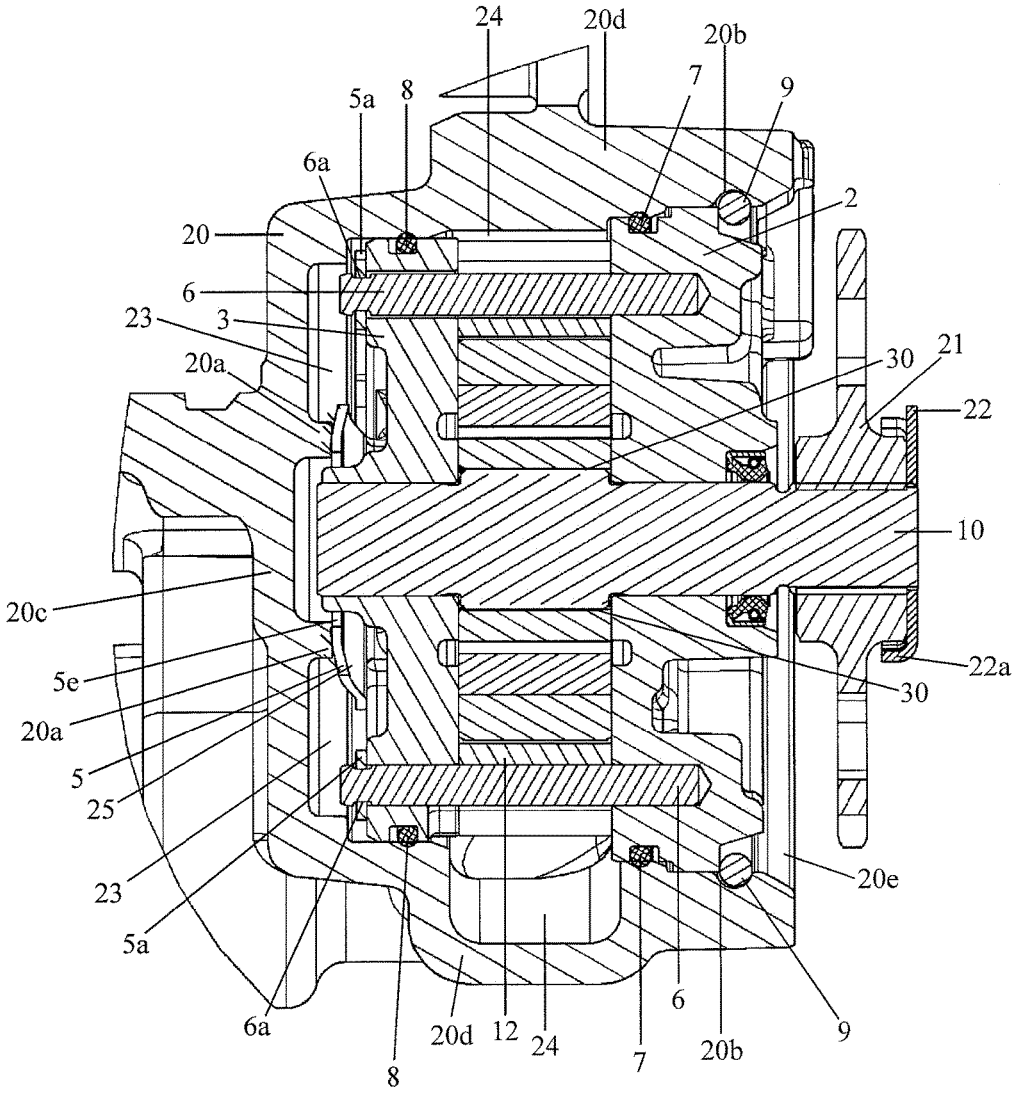
FIG. 2 the pump assembly from FIG. 1, inserted into an accommodating housing.

FIG. 1 shows a pump assembly which can be inserted into an accommodating housing 20, as shown in FIG. 2. The pump assembly comprises a spring 5 which is for example embodied as a disc spring and which is shown in various embodiments in FIGS. 4 to 10.

The pump or pump assembly from FIG. 1 comprises a rotor 4 which is non-rotationally connected to a pump shaft 10 of the pump 1 via a shaft-hub connection 30. The rotor 4 comprises cavities which serve as a guide and are in particular slot-shaped. A delivery element 13, in particular a vane, is assigned to each cavity. The vane 13 can be shifted radially back and forth in its cavity, away from and towards the rotational axis of the rotor 4, in particular guided with one translational degree of freedom, as can best be seen from FIG. 15. The vanes 13 are rotated along with the rotor 4. The pump 1 comprises an annular housing part 12, which for better identification may be referred to as the third housing part 12. The third housing part 12 can be embodied as a stroke ring. The third housing part 12 is trapped between a first housing part 2 and a second housing part 3 and is non-rotational in relation to the first and second housing parts 2, 3. The space which extends annularly around the pump shaft 10, and which is surrounded by the inner circumference of the third housing part 12 and axially delineated by the first and second housing parts 2, 3, can also be referred to as the pump chamber 26. The rotor 4 and the vanes 13 are arranged in the pump chamber 26.

Figure 15:
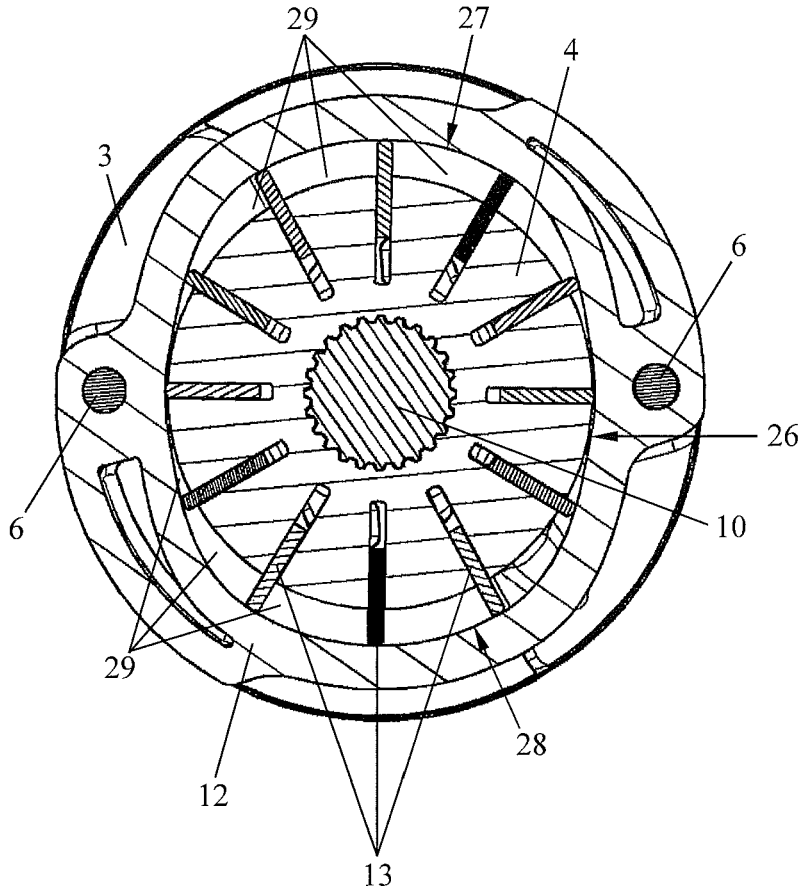
FIG. 15 a cross-section view through the pump assembly from FIGS. 1 to 3.

As can best be seen from FIG. 15, at least one delivery chamber 27, 28 is formed radially between the rotor 4 and the third housing part 12. The embodiment shown here comprises two delivery chambers, namely a first delivery chamber 27 and a second delivery chamber 28.

A delivery cell 29 is respectively formed between adjacent vanes 13 and changes its volume as a function of the rotational position of the rotor 4 about its rotational axis. Since the pump comprises a number of vanes 13, it also exhibits a corresponding number of delivery cells 29. A number of delivery cells are situated in each of the delivery chambers 27, 28.

The vanes 13 and the rotor 4 form a first sealing gap with the first housing part 2 and a second sealing gap with the second housing part 3.

The third housing part 12, in particular the stroke ring, and/or the vanes 13 can be magnetised, such that the vanes 13 abut the inner circumferential surface of the third housing part 12 due to magnetic force, including in particular when the rotor 4 is not being rotated. This allows pressure to be built up in good time during a start or cold start, i.e. when the pump shaft 10 begins to be rotated. Alternatively or additionally, the vanes 13 can be pressed outwards, i.e. away from the rotational axis of the rotor 4 and towards the inner circumferential surface of the third housing part 12, due to the centrifugal force while the rotor 4 rotates. The vanes 13 and/or each of the vanes 13 forms a third sealing gap with the inner circumferential surface of the third housing part 12.

The inner circumferential surface of the third housing part 12 exhibits a contour which causes the vanes 13 to extend (increasing the volume of the delivery cell 29) at least once and to retract (decreasing the volume of the delivery cell 29) at least once during one complete revolution of the rotor 4. The pump 1 shown in the example is a twin-stroke pump, i.e. comprises two delivery chambers 27, 28, wherein the vanes 13 for each delivery chamber 27, 28 extend once and retract once when they are moved through the delivery chamber 27, 28 by means of rotating the rotor 4. This means that the vanes 13 extend, retract, extend and retract again in other words, extend twice and retract twice during one complete revolution of the rotor 4. A delivery cell 29 is respectively formed between adjacent vanes 13 and is increased and/or decreased in volume by extending and retracting the vanes 13 which delineate it, namely as a function of the contour of the inner circumferential surface of the third housing part 12.

Figure 3:
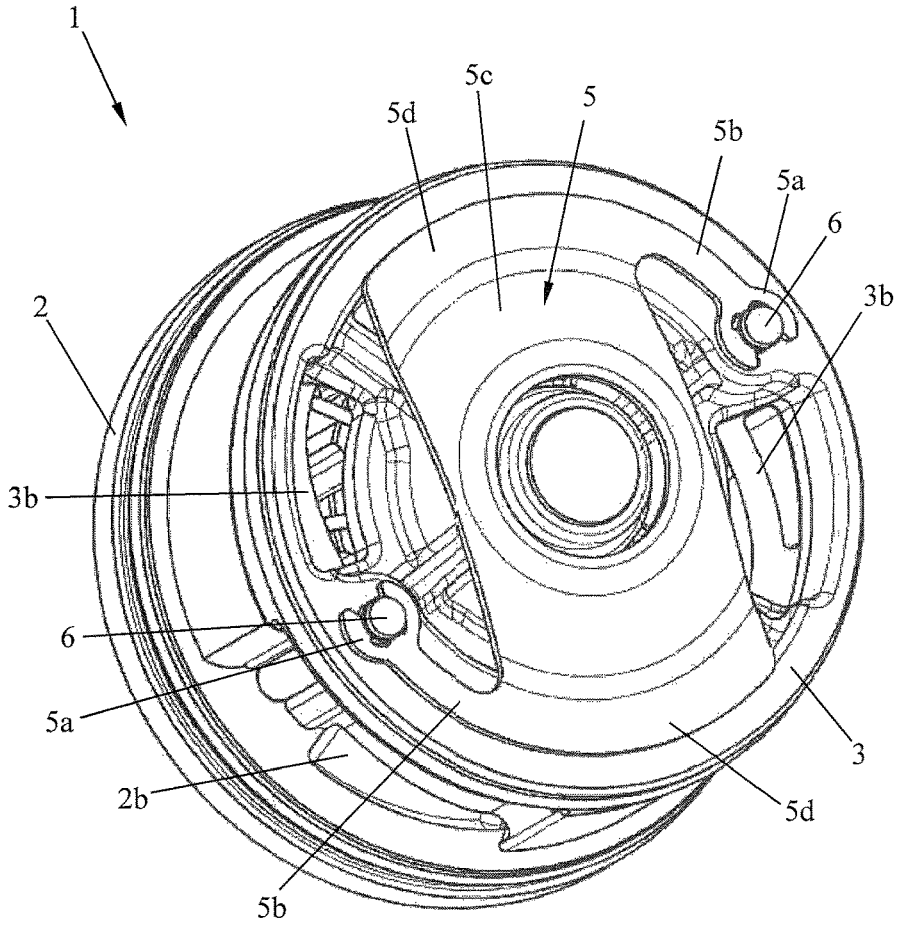
FIG. 3 a perspective view of the pump assembly from FIG. 1.

As can best be seen from FIG. 3, the pump 1 comprises an opening or channel 3*b* which ports into the region of the delivery chamber 27, 28 in which the volume of the delivery cells 29 decreases while the rotor 4 rotates. This means that fluid, such as for example oil, situated in the delivery cells is displaced through the channel 3*b*, which in this case serves as an outlet.

The pump 1 comprises an opening and/or channel 2*b* which ports into the region of the delivery chamber 27, 28 in which the volume of the delivery cells 29 increases while the rotor 4 rotates. This means that fluid is delivered or suctioned through the channel 2*b* into the expanding delivery cell 29. Since the pump 1 in this example is a two-stroke pump, it comprises two inlet channels 2*b* and two outlet channels 3*b*, wherein the first inlet channel 2*b* and the first outlet channel 3*b* port into the first delivery chamber 27, and the second inlet channel 2*b* and the second outlet channel 3*b* port into the second delivery chamber 28. A reverse configuration of the inlet and outlet channels 2*b*, 3*b* is equally conceivable, i.e. the channel 2*b* can be the outlet channel, and the channel 3*b* can be the inlet channel.

When the rotor 4 rotates, fluid—in particular, liquid—is suctioned through the channel 2*b* into the expanding delivery cells 29 and transported into the region which the channel 3*b* ports into, wherein the fluid is outputted from the then-contracting delivery cells 29 via the channel 3*b*.

The pump 1 comprises at least one positioning element 6 (two positioning elements 6 in the example shown). The positioning elements 6 are pins and/or are pin-shaped. The positioning element 6 is firmly anchored in the first housing part 2. The first housing part 2 comprises a blind bore 2*a* into which a first end of the pin-shaped positioning element 6 is pressed.

The pin-shaped positioning element 6 positions the second housing part 3 and the third housing part 12 with respect to their angular positions about the rotational axis relative to the first housing part 2. The second housing part 3 and the third housing part 12 comprise cavities, apertures, bores or elongated holes, preferably exhibiting a radial extent, through which the positioning element 6 extends. In the example shown, the third housing part 12 comprises a cavity 12*a* for this purpose. The second housing part 3 comprises a transit bore through which the positioning element 6 extends. The pin-shaped second end of the positioning element 6 protrudes past the end-facing side which points away from the pump chamber 26. This protruding portion of the positioning element 6 comprises a cavity, such as for example an annular groove 6*a*, or at least a part thereof, which extends over the circumference of the positioning element 6. A securing element or fastening element 5*a* is arranged in the cavity 6*a* and fastened to the positioning element 6 and/or in the annular groove 6*a*, in particular in a force fit and/or positive fit. The fastening element 5*a* prevents the first housing part 2, the second housing part 3 and the third housing part 12 from axially falling apart; in other words, it prevents the second and third housing part 3, 12 from being removed from the positioning element 6.

The spring 5 can for example be embodied as: a disc spring; a star disc or other element exhibiting geometries of a star disc; or a corrugated spring or other element comprising structures of a corrugated spring. In the example featuring a disc spring, the latter can comprise a main portion 5*c* which is connected to the fastening element 5*a* via an arm 5*b*. In the example shown, the (disc) spring 5 comprises two fastening elements 5*a* which are respectively connected to the main portion 5*c* via an arm 5*b*. On the one hand, the fastening element 5*a* prevents the housing parts 2, 3, 12 from detaching from each other; on the other hand, it enables the spring 5 to be fastened to the pump unit and/or the positioning element 6. The main portion 5*c* of the spring 5 is arranged such that it is offset with respect to the fastening element 5*a* and/or supporting portion 5*d* along the rotational axis of the rotor 4 or pump shaft 10. The fastening element 5*a*, and/or the supporting portion 5*d* which points towards the second housing part 3, abut the second housing part 3 or are supported on it. The fastening element 5*a* and/or the supporting portion 5*d* abut, over as broad an area as possible, at least one correspondingly formed and preferably level surface of the second housing part 3. The main portion 5*c*, by contrast, is spaced from the second housing part 3 by a gap or spring gap. The main portion 5*c* can therefore flex towards the second housing part 3, thus tensing the spring 5, and flex away from the second housing part 3, thus relaxing the spring 5. The main portion 5*c* can abut, preferably over as broad an area as possible, at least one surface which is for example level and which is formed by a substantially annular collar of the end-facing wall 20*c*. When considering the rigidity/tensions and/or the spring diagram (force/displacement curve) of the spring 5, the spring 5 in particular preferably abuts the second housing part 3 and the accommodating housing 20, in particular the end-facing wall 20*c* or the at least one surface of the substantially annular collar, over as broad an area as possible.

The main portion 5*c* of the spring 5 comprises an aperture 5*e* which is in particular circular and through which a portion of the second housing part 3 extends. This enables a compact design to be achieved.

The spring 5 can comprise or be a spring made of metal, which can optionally be at least partially or completely coated in a plastic material, including by injection-moulding the plastic around the spring, or provided with integrally moulded geometries, wherein the plastic material is in particular an elastomer or a material in which the main constituent is an elastomer. The coating, surrounding injection-mould or integrally moulded geometries mean that the spring 5 take perform an additional function as a seal.

The pump shaft 10 is rotatably mounted on the first and second housing part 2, 3, in particular by means of a slide bearing in each case.

An outer structure, such as for example an outer toothed gearing, is formed on the pump shaft 10 between the portion of the pump shaft 10 which is rotatably mounted in the second housing part 3 and the portion of the pump shaft 10 which is rotatably mounted in the first housing part 2, and is in a positive-fit engagement with a corresponding inner structure, in particular an inner toothed gearing of the rotor 4, in order to establish a shaft-hub connection 30. The outer diameter of the outer structure of the pump shaft 10 is larger than the diameter of the portion of the pump shaft 10 which is mounted in the first housing part 2 and/or in the second housing part 3. The pump shaft 10 is arranged, axially fixed, between the first and second housing parts 2, 3, i.e. such that shifting the pump shaft 10 along the rotational axis is substantially impossible in both directions. For this purpose, the inner diameter of the portions of the first housing part 2 and second housing part 3 which mount the pump shaft 10 is smaller than the outer diameter of the outer structure of the pump shaft 10.

The end-facing side of the first housing part 2 which points away from the pump space comprises an annular pocket in which a shaft seal 11 is arranged. The shaft seal 11 is fastened, rotationally fixed, to the first housing part 2 and forms a sealing gap with the pump shaft 10. The shaft seal 11 seals off the pump space with respect to the outside.

The end of the pump shaft 10 which lies opposite the end arranged in the region of the spring 5 comprises an outer structure for a shaft-hub connection 30 comprising a toothed wheel 21, in particular a sprocket. The toothed wheel 21 is seated non-rotationally on the pump shaft 10. The toothed wheel 21 can be driven by a chain which is in turn driven by for example a crankshaft or other shaft which can be connected to for example an engine of the vehicle. For fastening it to the pump shaft 10, the toothed wheel 21 comprises an inner thread via which it is screwed to an outer thread of the pump shaft 10, up against a collar of the pump shaft 10. A rotational securing device 22 which is seated, secured against rotating, on the shaft 10 secures the toothed wheel 21 against becoming unintentionally detached. The rotational securing device 22 comprises an angled portion 22*a* which engages with the toothed wheel 21 in a positive fit, thus preventing the toothed wheel 21 from becoming detached.

The pump unit from FIG. 1 is inserted into an accommodating housing, for example a cup-shaped accommodating housing 20, such as for example a housing cup (FIG. 2). The accommodating housing 20 comprises a circumferential wall 20*d* which circumferentially surrounds the pump unit 1 from FIG. 1. The accommodating housing 20 also comprises an end-facing wall 20*c* which is connected to the circumferential wall 20*d*, wherein the main portion 5*c* of the spring 5 is supported on the end-facing wall 20*c*, in particular on a projection 20*a* of the end-facing wall 20*c* which is for example an annular projection.

The pump unit from FIG. 1 is held between the end-facing wall 20*c* and an axial securing element 9, in particular an axial securing ring arranged in an annular groove 20*b* of the circumferential housing 20, such that the spring 5 is tensed.

Figure 4:
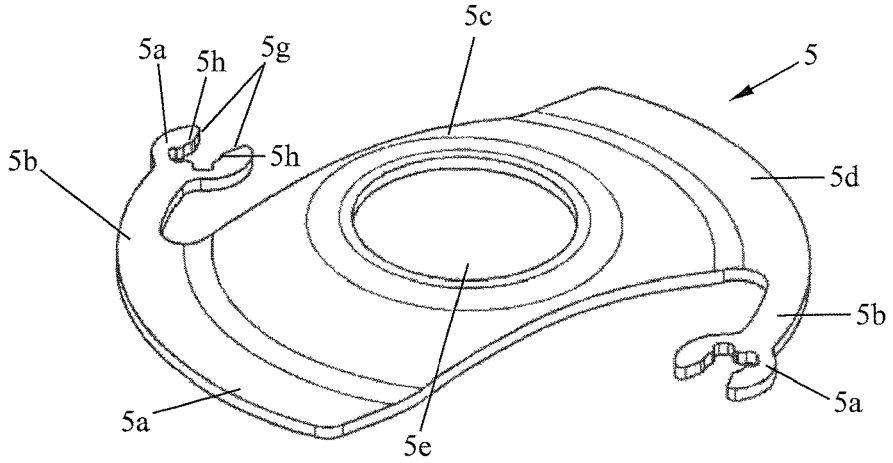
FIG. 4 the spring of the pump assembly from FIG. 3.

A first space 23 (pressure space), into which the fluid (liquid) delivered by the pump 1 is delivered, is formed between the end-facing wall 20*c* and a second seal 8 which is arranged in an annular groove arranged on the outer circumference of the second housing part 3 and which forms a sealing gap with the circumferential wall 20*d*. The space 23 is in turn connected to a fluid consumer, such as for example a lubricant consumer, in particular a transmission, by means of a channel (not shown). A second space 24 (suction space), from which fluid is delivered into the space 23 via the pump 1, is formed between the second seal 8 and a first seal 7 which is arranged in an annular groove arranged on the outer circumference of the first housing part 2 and which forms a sealing gap with the circumferential wall 20*d*. The space 24 can for example be connected to a storage container for the fluid by means of a channel. When the fluid is being delivered, the pressure in the space 23 is increased as the rotational speed increases, whereby the second housing part 3 jams the third housing part 12 firmly between the first and second housing part 2, 3, in addition to the biasing force of the spring 5. The first, second and third housing parts 2, 3, 12 are thus sealed off with respect to each other. The connection between the axial securing element 9 and the first housing part 2 is embodied to be strong enough that it can withstand, i.e. is not detached by, the axial force on the axial securing element 9 which is generated by the pressure in the space 23. As an alternative to forming the axial securing element 9 as a spring washer, a housing cover can be fastened to the accommodating housing 20 on which the first housing part 2 is axially supported. The spring 5 used in FIG. 3 is shown in FIG. 4. The spring 5 from FIG. 8 is similar to the spring 5 from FIG. 4.

Figure 8:
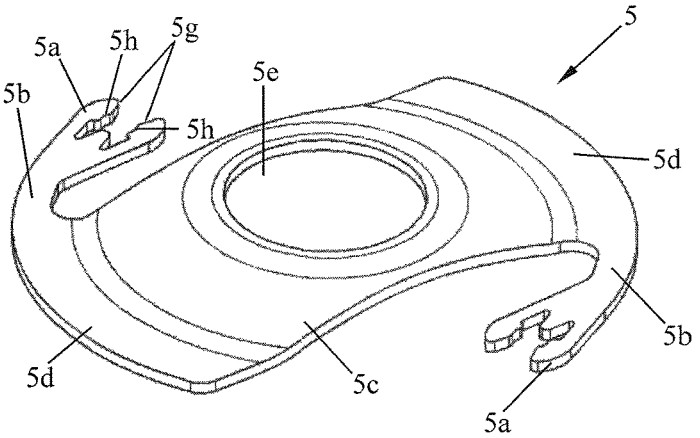
FIG. 8 a fourth alternative embodiment of a spring.

The fastening element 5*a* of the spring 5 from FIGS. 4 and 8 comprises two limbs which are arranged in the cavity 6*a*. In these embodiments, the spring 5 can be fastened to the positioning elements 6 by means of its fastening elements 5*a* by rotating it about the rotational axis of the rotor 4. The limbs each comprise two sliding surfaces 5*g* which point towards each other and are arranged with respect to each other such that the clear width formed between them expands towards the free end of the limbs. The thickness of the limbs is less than the clear width between the groove flanks of the cavity 6*a* in the positioning element 6. The portion of the reduced core diameter in the cavity 6*a*, i.e. the diameter of the positioning element 6 as measured at the base of the groove, is trapped between the two limbs of the fastening element 5*a* in a positive fit. While the spring 5 is fastened to the positioning elements 6, the limbs are elastically widened slightly, in that the sliding surfaces 5*g* which point towards each other slide off on the reduced-diameter portion of the cavity 6*a*. The limbs then in particular latch onto the reduced-diameter portion. To assist this, the limbs can each exhibit a concavely curved recess surface 5*h*. The recess surfaces 5*h* can abut the reduced-diameter portion, preferably over an area, when the fastening element 5*a* is completely arranged in the cavity 6*a*. This secures the spring 5 in a positive fit against rotating counter to the rotational direction in which the spring 5 has been rotated in order to fasten it to the positioning elements 6. The fastening element 5*a* comprises a projection between the limbs, which comprises an abutting surface which can abut the reduced-diameter portion of the positioning element 6 when the fastening element 5*a* is completely arranged in the cavity 6*a*.

Figure 5:
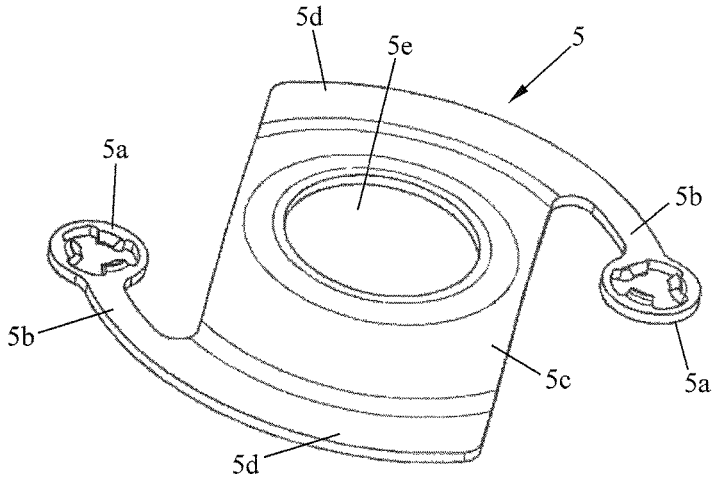
FIG. 5 a first alternative embodiment of a spring.
Figure 6:
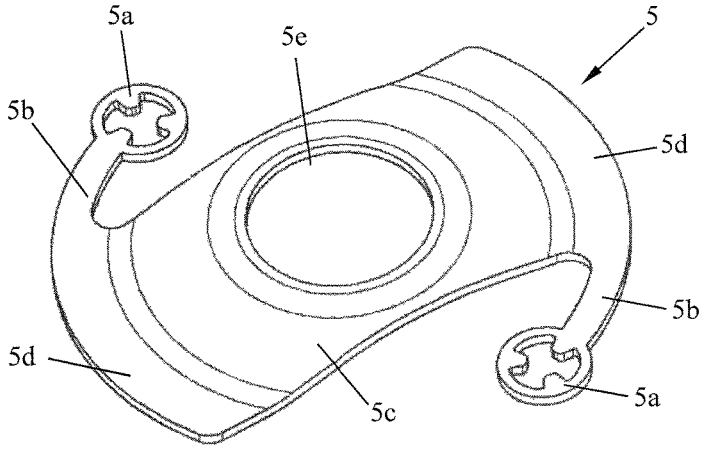
FIG. 6 a second alternative embodiment of a spring.

The fastening elements 5*a* shown in FIGS. 5 and 6 are similar to each other. The fastening element 5*a* is shaped as a closed ring and its inner circumference comprises three projections which enclose a diameter which is larger than the reduced-diameter portion in the cavity 6*a* and smaller than the outer diameter of the pin-shaped positioning element 6. The fastening element 5*a* from FIG. 5 exhibits facets or chamfers on its three projections, which the embodiment from FIG. 6 does not exhibit. In order to fasten the spring 5, the fastening elements 5*a* are respectively slid axially over a positioning element 6, until the three projections of the fastening element 5*a* latch into the cavity 6*a*. It also holds here that the thickness of the fastening element 5*a* is less than the clear width between the groove flanks of the cavity 6*a*.

Figure 7:
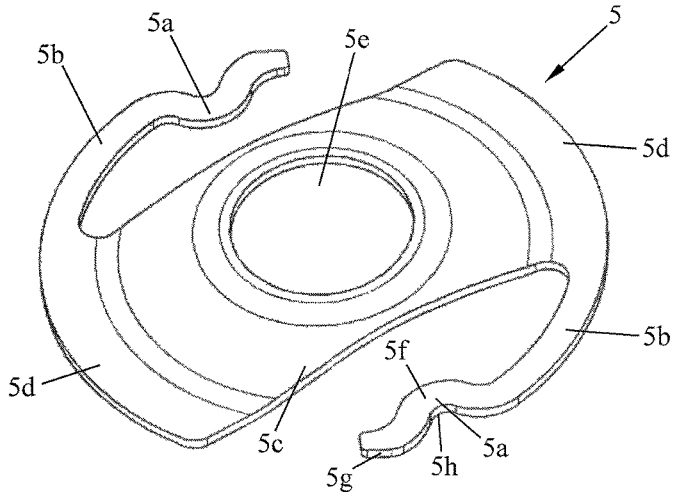
FIG. 7 a third alternative embodiment of a spring.

FIG. 7 shows a fastening element 5*a* which exhibits a recess 5*f* towards the outside, i.e. pointing away from the rotational axis. The spring 5 from FIG. 7 can be fastened to the positioning elements 6 by means of rotating it about the rotational axis. The two fastening elements 5*a* each comprise one free end which is arranged more distantly in relation to the arm 5*b* than the recess 5*f*. The free end, in particular a sliding surface 5*g* of the free end which points away from the rotational axis and slides off on the positioning element 6 while the spring 5 is fastened, is arranged more distantly in relation to the rotational axis than the recess 5*f*, in particular a recess surface 5*h* of the recess 5*f* which points away from the rotational axis. This embodiment causes the free end to be deflected by the positioning element 6 during fastening, in that the sliding surface 5*g* slides off on the positioning element 6 and the recess 5*f* flexes into the cavity 6*a*. This results in a positive-fit connection. The thickness of the fastening element 5*a* is also, as in the other embodiments from FIGS. 4 to 10, less than the clear width between the groove flanks of the cavity 6*a*.

Figure 9:
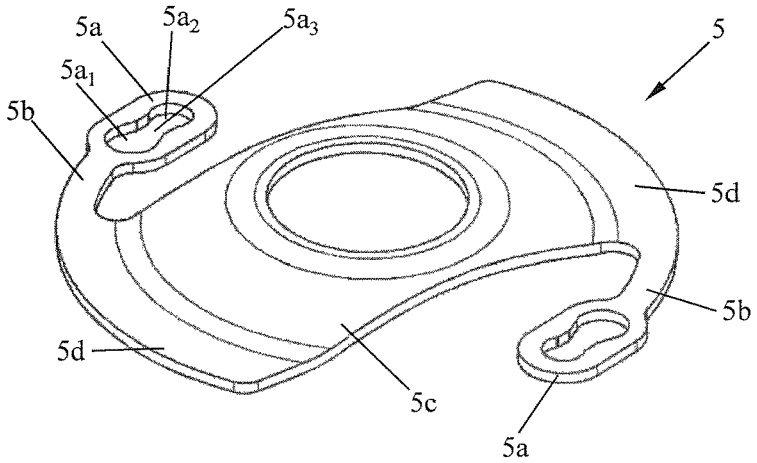
FIG. 9 a fifth alternative embodiment of a spring.

FIG. 9 shows an embodiment comprising a fastening element 5*a* which is shaped as a closed ring. The inner side of the ring of the annular fastening element 5*a* forms a contour featuring a first diameter portion $5a_1$ and a second diameter portion $5a_2$, which are connected via a constriction portion $5a_3$. The first diameter portion $5a_1$ exhibits an inner diameter which is larger than the outer diameter of the positioning element 6. The second diameter portion $5a_2$ exhibits an inner diameter which is smaller than the outer diameter of the positioning element 6 and larger than the diameter of the positioning element 6 in the cavity 6*a*. The clear distance between the flanks of the constriction portion $5a_3$ is smaller, in particular only slightly smaller, than the diameter of the positioning element 6 in the cavity 6*a*. In order to fasten the spring 5 to the at least one positioning element 6, the first diameter portion $5a_1$ of the fastening element 5*a* is fitted onto the positioning element 6. By rotating the spring 5, the second diameter portion $5a_2$ of the fastening element 5*a* is pivoted into the cavity 6*a*, whereby the constriction portion $5a_3$ is elastically widened at the reduced-diameter portion in the cavity 6*a*, and constricts again once it has moved past the reduced-diameter portion.

Figure 10:
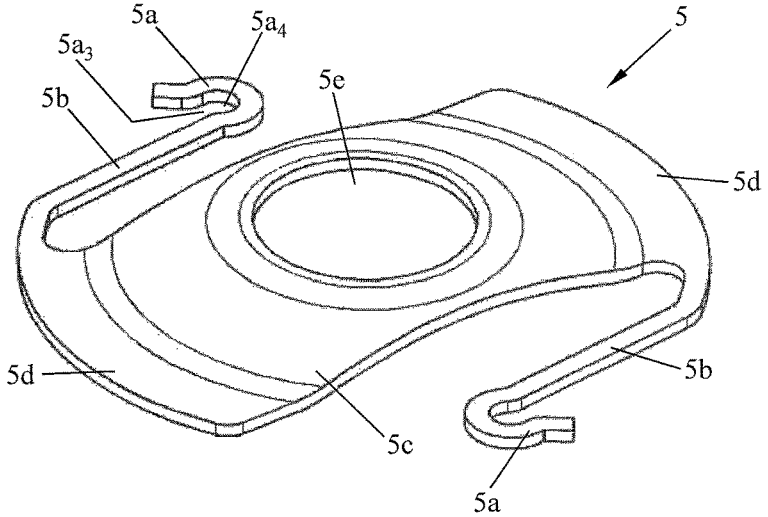
FIG. 10 a sixth alternative embodiment of a spring.

The spring 5 from FIG. 10 shows at least one fastening element 5*a* which is embodied to be hook-shaped, wherein a hook-shaped portion extends by more than 180° around a receiving portion $5a_4$. The receiving portion $5a_4$ is adjoined by a constriction portion $5a_3$ in which the clear distance is smaller than the diameter of the receiving portion $5a_4$. The diameter of the receiving portion $5a_4$ is larger than the diameter of the positioning element 6 in the cavity 6*a* and smaller than the outer diameter of the positioning element 6. The clear distance between the flanks of the constriction portion $5a_3$ is smaller, in particular slightly smaller, than the diameter of the positioning element 6 in the cavity 6*a*. By rotating the spring 5, the constriction portion $5a_3$ is initially pivoted or moved past the reduced-diameter portion in the cavity 6*a*, whereby the constriction portion $5a_3$ is elastically widened slightly and then constricts again.

Figure 11:
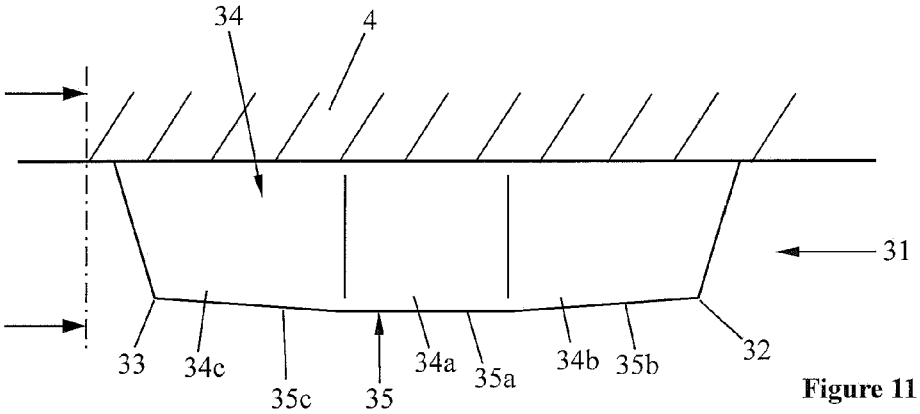
FIG. 11 a representation of an individual tooth of a toothed gearing, in a sectional plane which extends parallel to the rotational axis.

FIG. 11 shows a tooth 31 of an inner toothed gearing formed on the rotor 4. The features shown for the tooth 31 of the inner toothed gearing can alternatively or additionally apply to the tooth or teeth of the outer toothed gearing (not shown in detail).

One tooth is described in the following, wherein the teaching applies analogously to a number of teeth, in particular to each tooth, of the outer toothed gearing and/or inner toothed gearing.

Figure 13:
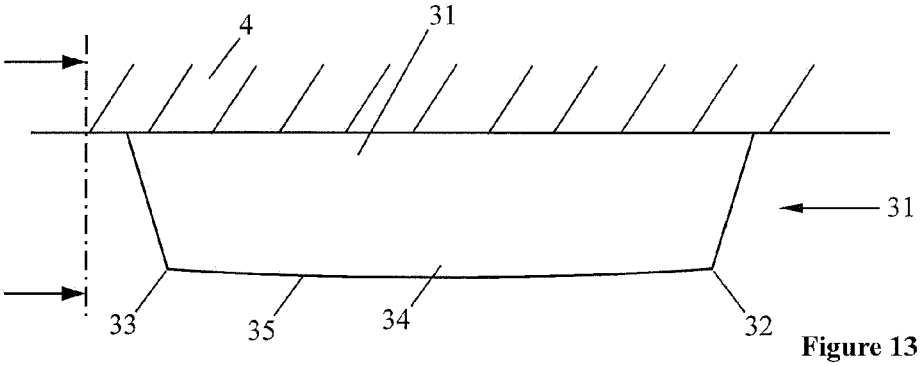
FIG. 13 another embodiment of a tooth, in a sectional plane parallel to the rotational axis.

The embodiments from FIGS. 11 and 13 are similar to each other, wherein one difference is that a tip surface 35, which in FIG. 13 is one roundly curved surface, is formed by a number of surface portions 35*a* to 35*c* in FIG. 11. Another difference is that the flank surface 34, which in FIG. 13 is roundly curved, is formed by a number of surface portions 34*a* to 34*c* in FIG. 11.

As can be seen from FIGS. 11 and 13, the tooth 31 is formed on the rotor 4 via a root of the tooth and is therefore part of the inner toothed gearing. As mentioned, the tooth 31 can alternatively be part of an outer toothed gearing, wherein the tooth 31 can be formed on the pump shaft 10 via its root.

The tooth 31 comprises a first end 32 and a second end 33. A convexly curved tip surface 35 which is curved convexly outwards, i.e. convexly away from the root of the tooth, is formed at the freely projecting end of the tooth 31 between the first end 32 and second end 33 and between the first and second flank surfaces 34, 36 of the tooth 31. In FIG. 11, the tip surface 35 is formed from a number of surface portions 35*a* to 35*c*. A linear first surface portion 35*a*. Which is arranged parallel to the rotational axis of the part on which the tooth 31 is formed, is formed approximately in the middle between the first end 32 and the second end 33. In the example from FIGS. 11 and 13, this is the rotational axis of the rotor 4; alternatively, it can be the rotational axis of the pump shaft 10. A linearly extending second surface portion 35*b* which is slightly inclined in relation to the rotational axis is formed between the first surface portion 35*a*, which extends linearly between the ends 32, 33, and the first end 32. A linear third surface portion 35*c* which is slightly inclined in relation to the rotational axis is arranged between the second end 33 and the first surface portion 35*a*. The first, second and third surface portions are arranged with respect to each other such that they form a tip surface 35 which is convexly curved or crowned away from the root of the tooth.

In the embodiment from FIG. 13, the tip surface 35 is one surface, which is convexly curved away from the root of the tooth in one or alternatively two dimensions, between the first end 32 and the second end 33.

The tooth 31 from FIG. 11 comprises a first flank surface 34 and a second flank surface (on the hidden reverse side). These flank surfaces can be formed identically. The flank surface 34 comprises a first surface portion 34*a* which extends linearly, in particular as a plane, approximately in the middle between the first end 32 and the second end 33. A second surface portion 34*b* is formed between the first end 32 and the first surface portion 34*a*, and a third surface portion 34*c* is formed between the first surface portion 34*a* and the second end 33. The surface portions 34*b*, 34*c* are planes which are slightly angled in relation to the surface portion 34*a*, such as for example by 3° at most or by 1° at most.

The tooth from FIG. 13 likewise comprises a first flank surface 34 and a second flank surface 36 (FIG. 14; hidden in FIG. 13) which can be embodied identically. The flank surface 34 extends from the first end 32 to the second end 33 and is convexly curved outwards.

Figure 12A:
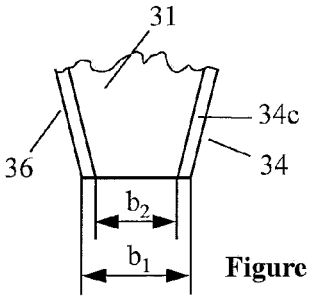
FIG. 12*a* a first variant of a tooth from FIG. 11, from the direction of view indicated in FIG. 11.
Figure 12B:
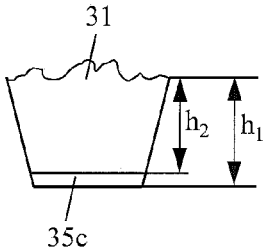
FIG. 12*b* a second variant of a tooth from FIG. 11, from the direction of view indicated in FIG. 11.
Figure 12C:
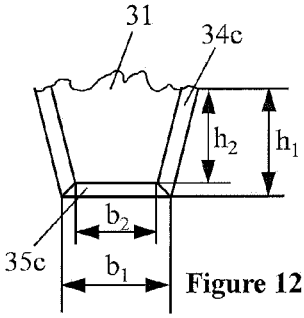
FIG. 12*c* a third variant of a tooth from FIG. 11, from the direction of view indicated in FIG. 11.
Figure 14A:
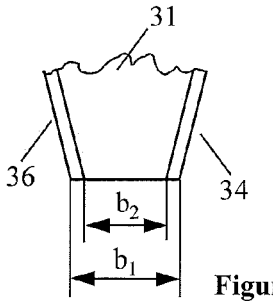
FIG. 14*a* a first variant of a tooth from FIG. 13, from the direction of view indicated in FIG. 13.
Figure 14B:
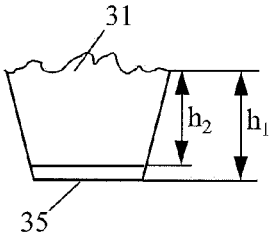
FIG. 14*b* a second variant of a tooth from FIG. 13, from the direction of view indicated in FIG. 13.
Figure 14C:
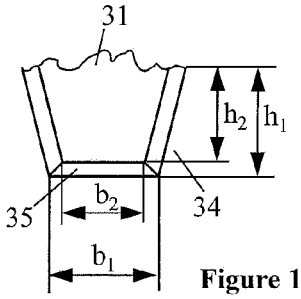
FIG. 14*c* a third variant of a tooth from FIG. 13, from the direction of view indicated in FIG. 13.

FIGS. 12*a* and 14*a* each show a tooth 31 in which the flank surfaces 34, 36 are convexly curved. FIGS. 12*b* and 14*b* each show a tooth 31 in which the tip surface 35 is convexly curved. FIGS. 12*c* and 14*c* each show a tooth 31 in which the tip surface 35 and the flank surfaces 34, 36 are convexly curved.

Due to the convexly curved tip surface 35 and/or the convexly curved flank surfaces 34, 36, the pump shaft 10 can be tilted about its rotational axis in relation to the rotational axis of the rotor 4 by a small angle, such as for example 3° at most or 1° at most. The tooth 31 exhibits a tooth height $h_1$ in the region of the first surface portion 34*a*, 35*a* or in the middle between the first end 32 and the second end 33, which decreases to a height $h_2$ towards the first end 32 and the second end 33.

The tooth 31 can exhibit a tooth width $b_1$ in the region of the first surface portion 34*a*, 35*a* or in the middle between the first end 32 and the second end 33, which decreases to a tooth width $b_2$ towards the first end 32, such as for example in the second surface portion 34*b*, 35*b*. The tooth 31 can exhibit the tooth width $b_1$ in the region of the first surface portion 34*a*, 35*a* or in the middle between the first end 32 and the second end 33, which decreases to the tooth width $b_2$ towards the second end 33, such as for example in the third surface portion 34*c*, 35*c*. The decrease in the tooth widths and/or tooth heights is shown in FIGS. 12*a* to 12*c* and in FIGS. 14*a* to 14*c*.

LIST OF REFERENCE SIGNS

1 pump
2 first housing part
2*a* cavity, such as for example a blind bore
2*b* opening, such as for example an outlet or inlet
3 second housing part
3*a* cavity, such as for example a transit bore
3*b* opening, such as for example an inlet or outlet
4 rotor
5 spring
5*a* securing element/fastening element
5$a_1$ first diameter portion
5$a_2$ second diameter portion
5$a_3$ constriction portion
5$a_4$ receiving portion
5*b* arm
5*c* main portion
5*d* supporting portion
5*e* cavity/aperture
5*f* recess
5*g* sliding surface
5*h* recess surface
6 positioning element/pin
6*a* cavity, such as for example an annular groove
7 first seal/sealing ring
8 second seal/sealing ring
9 axial securing element
10 pump shaft
11 shaft seal
12 third housing part/stroke ring
12*a* cavity
13 delivery element/vane
20 accommodating housing, such as for example a housing cup
20*a* projection
20*b* cavity, such as for example an annular groove
20*c* end-facing wall
20*d* circumferential wall
20*e* opening
21 toothed wheel, such as for example a sprocket
22 rotational securing device
22*a* angled portion
23 first space/pressure space
24 second space/suction space
25 spring gap
26 pump chamber
27 first delivery chamber
28 second delivery chamber
29 delivery cell
30 shaft-hub connection
31 tooth
32 first end
33 second end
34 first tooth flank surface/flank surface
34*a* first surface portion of the tooth flank surface
34*b* second surface portion of the tooth flank surface
34*c* third surface portion of the tooth flank surface
35 tip surface
35*a* first surface portion of the tip surface
35*b* second surface portion of the tip surface
35*c* third surface portion of the tip surface
36 second tooth flank surface/flank surface
$b_1$ tooth width
$b_2$ tooth width
$h_1$ tooth height
$h_2$ tooth height

The invention claimed is:

1. A pump, comprising:

a rotor;

a first housing part and a second housing part, between which the rotor is arranged, the rotor being configured to be rotated about a rotational axis relative to the first and second housing part;

two or more positioning elements which position the second housing part with respect to its angular position about the rotational axis relative to the first housing part; and a spring which includes, or forms, two or more fastening elements, a main portion and at least one supporting portion, wherein a spring gap exists between the second housing part and the main portion such that said main portion is configured to flex towards and away from the second housing part along the rotational axis, and the at least one supporting portion is supported on the second housing part, wherein the second housing part is arranged between the spring and the rotor, wherein the spring is fastened to said two or more positioning elements by the two or more fastening elements.

2. The pump according to claim 1, wherein the spring is fastened, secured against rotating about the rotational axis, in a positive fit.

3. The pump according to claim 2, wherein said two or more positioning elements are formed by the first housing part or are anchored in the first housing part as a part which is separate from the first housing part.

4. The pump according to claim 1, wherein said two or more positioning elements are formed by the first housing part or are anchored in the first housing part as a part which is separate from the first housing part.

5. The pump according to claim 4, wherein a third housing part which surrounds the rotor over its circumference is arranged between the first housing part and the second housing part, wherein the third housing part is:

a part which is separate from the first and second housing part, a portion of the first housing part which is formed by the first housing part, or a portion of the second housing part which is formed by the second housing part.

6. The pump according to claim 1, wherein a third housing part which surrounds the rotor over its circumference is arranged between the first housing part and the second housing part, wherein the third housing part is:

a part which is separate from the first and second housing part;

a portion of the first housing part which is formed by the first housing part; or a portion of the second housing part which is formed by the second housing part.

7. The pump according to claim 1, wherein at least some of the main portion is arranged between the rotational axis and the at least one supporting portion.

8. The pump according to claim 1, wherein the two or more positioning elements each include a cavity with which the two or more fastening elements of the spring engage.

9. The pump according to claim 8, wherein each cavity is an annular groove which extends over the circumference of each respective positioning element, each positioning element is cylindrical or pin-shaped, and exhibits a width, extending along a longitudinal axis of each positioning element, which is dimensioned such that each respective fastening element of the spring is accommodated in the annular groove with a clearance along the longitudinal axis.

10. The pump according to claim 1, wherein the pump includes a pump shaft which is non-rotationally connected to the rotor and configured to be rotated about the rotational axis, wherein the pump shaft is mounted and configured to be rotated in the first housing part and in the second housing part.

11. The pump according to claim 10, wherein the spring includes a cavity through which the pump shaft or the structure of the second housing part which forms the pump shaft mounting extends.

12. The pump according to claim 1, wherein an accommodating housing which comprises a circumferential wall which extends around the rotational axis, and an end-facing wall which is arranged on the end-facing side of the circumferential wall, wherein the second housing part is surrounded over its circumference by the circumferential wall, and the main portion of the spring is supported on the end-facing wall.

13. The pump according to claim 12, an axial securing element which is fastened to the accommodating housing, wherein a pump assembly includes at least the first housing part, the second housing part, the rotor and a pump shaft and when tensed the spring presses the first housing part of the pump assembly against the axial securing element, wherein the axial securing element prevents the spring from being relaxed.

14. The pump according to claim 12, wherein a seal which is arranged between the second housing part and the accommodating housing seals off a first space, which is formed between the end-facing wall and the second housing part, in relation to a second space which is formed between the circumferential wall and the third housing part, wherein at least one of the first space is connected to a pump chamber, in which the rotor is arranged, by a first channel, and the second space is connected to the pump chamber by a second channel, and the first space is arranged on a suction side and the second space is arranged on a pressure side, or the second space is arranged on a suction side and the first space is arranged on a pressure side.

15. The pump according to claim 12, wherein the main portion of the spring is supported on an annular projection formed by the end-facing wall.

16. The pump according to claim 1, wherein the spring includes an elastomer material or polymer material.

17. The pump according to claim 16, wherein the spring is formed from an elastomer material or polymer material or from a metal spring which is partially or completely coated in the elastomer material or polymer material, or by injection moulding the elastomer material or polymer material around the metal spring.

* * * * *